US011043229B2

(12) United States Patent
Shlomovitz et al.

(10) Patent No.: US 11,043,229 B2
(45) Date of Patent: Jun. 22, 2021

(54) SYSTEM AND METHOD FOR DROWNING DETECTION

(71) Applicant: SOSENSE LTD., Tel Aviv (IL)

(72) Inventors: Tal Shlomovitz, Tel Aviv (IL); Moshe Harel Ben Moshe, Modi'in (IL); Aviv Farhi, Bnei-Atarot (IL); Ofer Verfel, Ein vered (IL); Tal Zuri, Moshav Herut (IL); Josef Rott, Yuvalim (IL); Asaf Friehmann, Herzelia (IL)

(73) Assignee: SOSENSE LTD., Tel Aviv (IL)

( * ) Notice: Subject to any disclaimer, the term of this patent is extended or adjusted under 35 U.S.C. 154(b) by 0 days.

(21) Appl. No.: 16/769,948

(22) PCT Filed: Dec. 5, 2018

(86) PCT No.: PCT/IL2018/051333

§ 371 (c)(1),
(2) Date: Jun. 4, 2020

(87) PCT Pub. No.: WO2019/111256

PCT Pub. Date: Jun. 13, 2019

(65) Prior Publication Data

US 2020/0395038 A1 Dec. 17, 2020

(30) Foreign Application Priority Data

Dec. 5, 2017 (IL) ..... 256138

(51) Int. Cl.
*G10L 25/51* (2013.01)
*G08B 21/08* (2006.01)
(Continued)

(52) U.S. Cl.
CPC ..... *G10L 25/51* (2013.01); *G08B 21/084* (2013.01); *G10L 21/0232* (2013.01);
(Continued)

(58) Field of Classification Search
CPC ..... G10L 25/51; G10L 21/0232; G10L 2021/02166; G08B 21/084; H04R 1/406; H04R 1/44; H04R 1/04; H04R 1/08; H04R 3/005; H04R 3/00; H04R 3/04; H04R 29/00; H04R 29/001; H04R 29/004; H04R 27/00; H04N 11/00; G01H 3/14; H04S 7/40; H04S 7/301
(Continued)

(56) References Cited

U.S. PATENT DOCUMENTS 4,187,502 A 2/1980 Beverly et al.
4,604,610 A 8/1986 Baker et al.
(Continued)

FOREIGN PATENT DOCUMENTS

GB 2502982 12/2013
WO 2018/122858 7/2018

*Primary Examiner* — Ahmad F. Matar
*Assistant Examiner* — Sabrina Diaz
(74) *Attorney, Agent, or Firm* — The Law Office of Joseph L. Felber

(57) ABSTRACT

A system and method for the detection of drowning within a body of water, the detection is provided by signal processing of acoustic signals obtained from within the body of water of acoustic signals received from an array of hydrophone submerged within the body of water.

27 Claims, 5 Drawing Sheets

(51) Int. Cl.

| | |
|---|---|
| ***G10L 21/0232*** | (2013.01) |
| ***H04R 1/40*** | (2006.01) |
| ***H04R 1/44*** | (2006.01) |
| ***H04R 3/00*** | (2006.01) |
| *G10L 21/0216* | (2013.01) |

(52) U.S. Cl.
CPC ..... *H04R 1/406* (2013.01); *H04R 1/44* (2013.01); *H04R 3/005* (2013.01); *G10L 2021/02166* (2013.01)

(58) Field of Classification Search
USPC ..... 381/56, 58, 122
See application file for complete search history.

(56) References Cited

U.S. PATENT DOCUMENTS 4,747,085 A * 5/1988 Dunegan ..... G08B 21/082 340/573.6
4,932,009 A * 6/1990 Lynch ..... G08B 21/082 340/566
5,142,508 A * 8/1992 Mitchell ..... G08B 21/082 367/141
5,144,285 A 9/1992 Gore
5,369,623 A 11/1994 Zerangue
5,638,048 A 6/1997 Curry
6,111,510 A 8/2000 Coffelt
6,327,220 B1 * 12/2001 Miller, Jr. ..... H04B 11/00 367/134
6,583,724 B1 6/2003 Rodriguez
7,019,649 B2 * 3/2006 Hoenig ..... G08B 21/082 340/566
2005/0258968 A1 * 11/2005 Philippe ..... G08B 21/084 340/573.6
2008/0106422 A1 5/2008 Sparks et al.
2008/0266118 A1 * 10/2008 Pierson ..... A61B 5/6826 340/573.6
2010/0026501 A1 2/2010 Cutler et al.
2010/0030482 A1 2/2010 Li
2012/0062377 A1 * 3/2012 Mock ..... G08B 21/088 340/539.11
2013/0328683 A1 * 12/2013 Sitbon ..... G08B 21/088 340/573.6
2014/0265842 A1 9/2014 Potucek et al.
2014/0268678 A1 9/2014 Potucek et al.
2015/0161870 A1 * 6/2015 Podlisker ..... G08B 21/08 340/573.6
2016/0042629 A1 * 2/2016 Snyder ..... G08B 21/088 340/573.6
2017/0213451 A1 7/2017 Potucek et al.
2019/0073889 A1 3/2019 Potucek et al.

* cited by examiner

SYSTEM AND METHOD FOR DROWNING DETECTION

FIELD OF THE INVENTION

The present invention relates to a system and method for the detection of drowning within a body of water, and in particular, to such a system wherein the detection is provided by processor implemented signal processing of acoustic signals from within the body of water.

BACKGROUND OF THE INVENTION

Drowning can occur in any body of water or the like environments such as a pool, lake, sea, ocean and even a bathtub. Drowning does not necessitate that the person does not know how to swim, other factors may come into play that lead to drowning, such as head trauma, orientation loss, disorientation and loss of consciousness.

Children of ages 2-9 are the high risk group for fatal drowning. Daily drowning statistics in the USA show that there are about 160 drowning incidents of which 120 receive first aid, 40 are hospitalized; 15 recover, 15 suffer irreversible damage and 10 are fatal cases.

Various forms of floatation devices and detections devices exist that function based on individual wearing protective gear such as life vests, floaties, swim rings, variously shaped inflatable floatation devices.

U.S. Patent Publication No. 2013/0328683 to Sitbon et al, teaches a wearable device for drowning detection based on signal processing specific of a an individual wearing the device.

U.S. Pat. No. 6,111,510 to Coffelt, discloses a system for underwater drowning detection system that is based on the presence and absence of a sound wave of a bodily function.

SUMMARY OF THE INVENTION

There is an unmet need for, and it would be highly useful to have a system and method capable of identifying a drowning incident occurring within a body of water while identifying and communicating the location of the drowning victim. Preferably the location of the individual is communicated to emergency respondents such as lifeguards, medical practitioners, or the like individuals and/or automated devices capable of treating or responding to such emergency events.

Embodiments of the present invention provide for detection of drowning incident by utilizing a system configured to monitor a body of water while listening for and detect an acoustic signature that is correlated with drowning. In embodiments, when such a drowning acoustic signature is detected an alarm state protocol is implemented. The alarm state preferably includes at least one of sounding and alarm, alerting competent first respondents, alerting emergency services, the like or any combination thereof.

In embodiments they system further provides for identifying the location of the drowning victim by identifying the location of the source of the acoustic signature.

In embodiments the system comprises an array of hydrophones that are submerged within a body of water that is being monitored. The hydrophone array is functionally linked to a processing device for performing digital signal processing and analysis of the acoustic signal provided by the hydrophone array. In embodiments the signal processing and analysis provide for detecting an acoustic signature indicative of drowning.

In embodiments the system may further comprise additional sensors that may be utilized to improve signal to noise ratio. For example a microphone may be placed external the body of water to determine background noise. For example, in a pool setting a microphone may be placed near the pool's water-pump and filter providing additional data of the surrounding noise.

In embodiments the system may further comprise additional submersible and/or under water sensors to improve signal to noise ratio from noise emanating from within the body of water being monitored. Such an underwater sensor module may comprises sensors for example including but not limited to movement sensor, accelerometer, gyro sensor, depth sensor, pressure sensor, temperature sensor, pH sensor, camera, optical sensor, the like, or any combination thereof configured to be submersible within the monitored body of water.

In embodiments the system may further be in communication with or functionally associated with at least one or more auxiliary devices for communicating an alarm state and/or sounding an alarm state. An auxiliary device may for example include but is not limited to a horn, an alarm, a communication device, a mobile communication device, a server, a first respondent call center, emergency services call center, the like or any combination thereof.

The system and method of the present invention preferably provides a safety measure against accidental drowning within an aqueous environment such as a pool, lake, ocean or the like body of water.

In embodiments the hydrophone array comprising a plurality of hydrophones may be distributed and/or arranged within the monitored body of water in any manner so as to provide sufficient coverage of the entire area of the body of water. For example the hydrophone array may be arranged in a grid arrangement, a concentric arrangement, a triangulation arrangement, single layer arrangement, multi-layered (depth) arrangement, the like or any combination thereof.

In some embodiments the hydrophone array may be arranged in a planar grid-like manner along a lower surface of the body of water, for example a swimming pool.

In some embodiments the hydrophone array may be arranged in multilayer arrangement wherein hydrophones are placed along a lower surface and along at least one or more side (wall) surface. For example, a first hydrophone array arrangement along the bottom surface of a pool and a second hydrophone array arrangement along the height of at least one or more walls of a pool.

In embodiments the hydrophones may be placed at a distance (d) from the walls and/or edges of a pool defining the body of water being monitored. distance d confirmed so as to ensure the quality of the acoustic signal bine monitored ad so as to reduce and/or circumvent any echo and/or reflection effect that may arise by placement of hydrophone along the edge of the body of water for example a pool wall.

In embodiments placement of each hydrophone is preferably provided with a unique location specific address for example a GPS address and/or coordinates. Preferably the unique hydrophone address is provided to facilitate identification and localization of the source of the drowning event within the body of water and to further provide for communicating the location of a drowning victim within the body of water. Optionally location is communicated to an auxiliary device and/or system as previously described and identifiable on a map.

In embodiments, individual hydrophones forming the hydrophone array may be further associated with a local sensor and/or transducer, for example including but not limited to a pH sensor and/or a temperature sensor, a light source, accelerometer, the like or any combination thereof. More preferably individual hydrophones may be associated with and/or adjacent to a temperature sensor to determine the ambient water temperature. In some embodiments a selective portion of the hydrophones array will be fit and/or functionally associated with a temperature sensor.

In embodiments the hydrophone array may be formed from a plurality of individual hydrophones that are functionally coupled with the processing center and/or device in a wired or wireless manner. Accordingly the hydrophones may be wireless and/or wired hydrophones that are functionally coupled and operational with the processing center and/or device.

In embodiments the processing center provides for implementing a proprietary processor mediated signal processing method of the acoustic signals received from the hydrophone array in order to monitor, detect and locate a drowning incident within a body of water.

In embodiments the processor mediated signal processing method comprises performing filtering and analysis in the frequency domain to identify a unique acoustic signature indicative of a drowning individual. The acoustic signature is identifiable and within a specific frequency band from about 200 Hz up to about 1200 Hz.

In embodiments, the processing center preferably comprises and/or is functionally associated with an acoustic signature bank and/or library and/or database of a pre-classified drowning acoustic signature signals that will preferably facilitate the process of the identification and analysis of the acoustic signals obtained from the hydrophone array.

Most preferably the acoustic signature is associated with acoustic waves generated by a drowning individual during a drowning event. The drowning sound may be explained on the basis of known anatomical defense reflexes that together are implemented to try to prevent entry of water or unwanted substance into the upper and lower respiratory system. These reflexes include a laryngospasm and a cough reflex that are known to be activated by irritant receptors that are located mainly on the wall of the trachea, pharynx, and carina, or by stimulation of the auricular branch (Arnold's reflex via internal laryngeal nerve). When both reflexes are triggered, axonal impulses of the vagus nerve begin a chain reaction that reaches the medulla, with efferent back in to respiratory system (glottis, vocal cords, diaphragm, intercostal muscles) is observed. A combination of these reflexes activate a blocking and/or repelling defensive actions to prevent water, or the like foreign object, from entering the respiratory system, and in turn gives rise to the unique drowning acoustic signature, monitored by the system and method defining embodiments of the present invention.

In embodiments, the processing center provides for identifying the location of the drowning incident by processing digital data received from the hydrophone array by utilizing a phase control processing techniques to generate a directional beam emanating from select hydrophones so as to determine and map the location of the drowning incident relative to the hydrophone array placement.

Within the context of this application the term hydrophone refers to an underwater microphone adept at obtaining acoustic signals under water. Any form of a hydrophone as is known in the art may be utilized.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

Citation or identification of any reference in this application shall not be construed as an admission that such reference is available as prior art to the invention.

Section headings are used herein to ease understanding of the specification and should not be construed as necessarily limiting.

Unless otherwise defined the various embodiment of the present invention may be provided to an end user in a plurality of formats, platforms, and may be outputted to at least one of a computer readable memory, a computer display device, a printout, a computer on a network or a user.

Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the present invention involves performing or completing certain selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

It should be noted that optionally any device featuring a data processor and/or the ability to execute one or more instructions may be described as a computer, including but not limited to a PC (personal computer), a server, a mini-computer, a cellular telephone, a smart phone, a PDA (personal data assistant), a pager, or the like. Any two or more of such devices in communication with each other, and/or any computer in communication with any other computer may optionally comprise a "computer network".

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 5A shows filtered raw signals, in the time domain, obtained from the hydrophone array; FIG. 5B shows the signal in the frequency domain following signal processing that identifies a drowning acoustic signature in the range between 200 Hz and 1200 Hz.

DESCRIPTION OF THE PREFERRED EMBODIMENTS

The principles and operation of the present invention may be better understood with reference to the drawings and the accompanying description.

The following figure reference labels are used throughout the description to refer to similarly functioning components are used throughout the specification hereinbelow.

Figure 1:
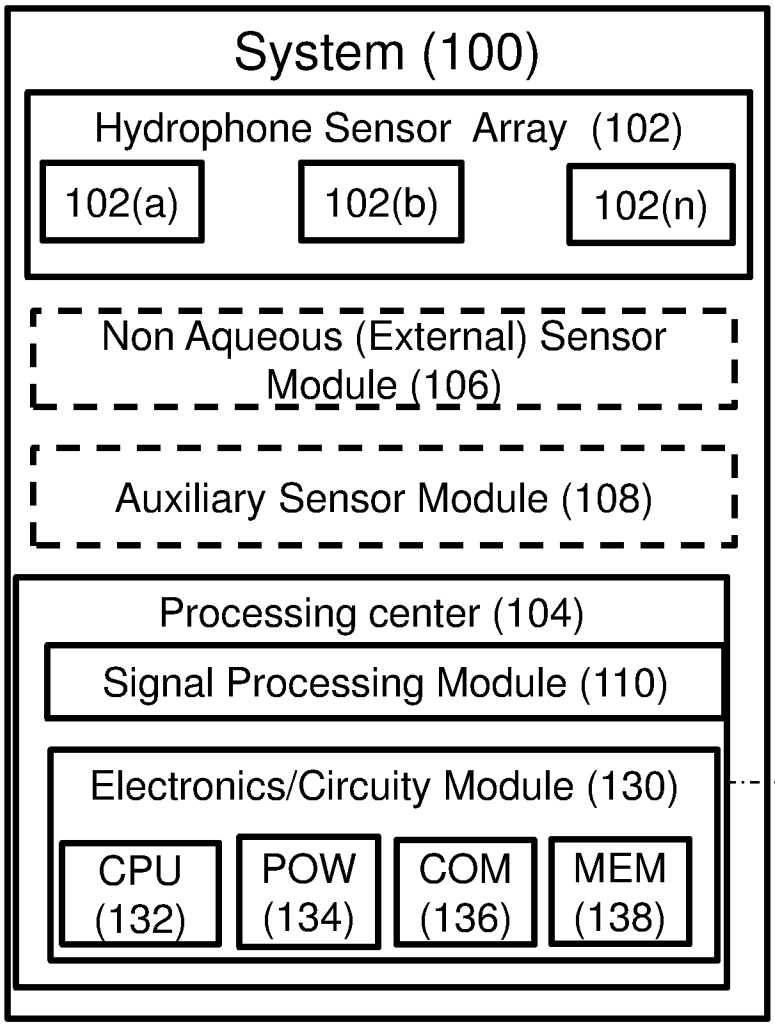
FIG. 1 is a schematic block diagram of a system for drowning detections according to an embodiment of the present invention.

10 monitored body of water;
12 pool systems;
20 auxiliary device;
100 monitoring system;
102 hydrophone array;
104 processing center;
105 alarm signal;
106 external environmental sensor;
108 in-water auxiliary sensor module;
110 signal processing module;
112 adaptive filter;
114 frame splitter;
116 frequency analysis;
118 signature library;
120 beam forming phase control module;
122 decision logic module;
124 alarm state module;
130 electronics/circuitry module;
132 microprocessor sub-module;
134 power sub-module;
136 communication sub-module;
138 memory sub-module;

Referring now to the drawings, FIG. 1 is a schematic block diagram of system 100 provided for monitoring a body of water for a drowning event, by implementing a processor mediated signal processing method for detecting a drowning event and altering of the same.

System 100 comprises a hydrophone array 102 including a plurality of hydrophones ($\mathbf{102}_{a \ldots n}$) including 'n' hydrophones where 'n' is at least four (n>4) that are submerged in the body of water being monitored, and a processing center 104 that provides processor mediated signal processing of the acoustic signals provided by the hydrophone array 102 so as to detect the drowning event.

In embodiments the hydrophone array 102 may take any form where the plurality of hydrophones may be distributed and/or arranged within the monitored body of water in any manner so as to provide sufficient coverage of the entire area of the body of water that is to be monitored.

For example the hydrophone array 102 may be arranged in a grid arrangement, a concentric arrangement, a triangulation arrangement, single layer arrangement, multi-layered (depth) arrangement, the like or any combination thereof.

In some embodiments the hydrophone array 102 may be arranged in a planar grid-like manner along and/or adjacent to a lower surface of the body of water, for example a swimming pool. For example in a non-limiting embodiment array 102 may be disposed along the swimming pool floor. For example, in a non-limiting embodiment array 102 may be disposed adjacent to a swimming pool floor and/or wall wherein individual hydrophones forming array 102 may be placed at a distance (d) above the swimming pool floor itself such that the hydrophones are suspended near the floor but not on the floor itself. In some embodiments distance (d) may be in the order of a few centimeters for example up to about 15 cm from the swimming pool floor.

In some embodiments the hydrophone array may be arranged in multilayer arrangement wherein hydrophones are placed along a lower surface and along at least one or more side (wall) surface. For example, a first hydrophone array arrangement may be placed along the bottom surface of a pool and a second hydrophone array arrangement along the height of at least one or more walls of a pool.

For example, a hydrophone array 102 disposed within a swimming pool may comprise at least four hydrophones 102*n*, that are organized in a grid-like manner, and distributed in two rows, wherein each row is disposed on the pool's floor and near the pool's wall, that is along opposite junctions of the pool's long edge. A first row disposed adjacent to the bottom of the left pool wall and a second row of hydrophones disposed opposite the first row, and placed adjacent to the bottom of the right pool wall.

For example in a non-limiting embodiment array 102 may be disposed along the swimming pool floor and/or side walls wherein individual hydrophones forming array 102 may be placed at a distance (d) from the wall and/or floor of the swimming pool such that the hydrophones are suspended near the floor and/or wall. In some embodiments distance (d) may be in the order of a few centimeters for example up to about 15 cm from the swimming pool wall and/or floor.

In embodiments the number of individual hydrophones 102*n* will be a function of the pool's dimensions. For example, a hydrophone may be placed at set intervals of about 1 meter and up to about 3 meters along the pool's length.

In embodiments placement of each hydrophone is preferably provided with a unique location specific address for example a GPS address and/or geographical coordinates. Preferably the unique hydrophone address is provided to facilitate communicating the location of a drowning incident and/or victim within the body of water. Optionally the location is communicated to an auxiliary device 20 and/or system and wherein the location is identifiable on a map.

In some embodiments system 100 may optionally further comprise a non-aqueous sensor module 106. Sensor module 106 provides for improving the signal to noise ratio of the acoustic signals picked up by the hydrophone array 102.

Sensor module 106 may comprise at least one or more microphone that are placed external the body of water to determine background noise sensed within the body of water.

For example, in an optional system 100 that is utilized in a pool setting, a microphone 106 may be placed adjacent to the pool's machine room to pick up acoustic signal emanating from the pool's water-pumps and filters providing so as to identify their contribution to noise and/or acoustic signals sensed by the hydrophone within the body of water. Such data may be utilized by system 100 to improve signal to noise ratio by provide additional data of potential environmental noise in and around the body of water. A further example, an external microphone may be placed to monitor above ground sounds in the perimeter of the body of water, for example a swimming pool, to improve signal to noise ratio where noise generated above the water surface may be removed and/or accounted for when monitoring and/or listing for an in water drowning acoustic signature signal. For example, noise generated by kids splashing and playing above the water surface that is received and/or picked up by the underwater hydrophone array 102 may be filtered out and/or accounted for and/or recognized as noise, so as to improve signal to noise ratio of the hydrophone signal.

In some embodiments system 100 may be further fit with an auxiliary in-water sensor module 108, including at least one or more submerged and/or underwater sensors and/or transducer to facilitate and/or improve the hydrophone signal. Such additional submersible and/or under water sensors 108 is provided to improve signal to noise ratio from noise emanating from within the body of water being monitored. Such an underwater sensor module 108 may comprise sensors for example including but not limited to movement sensor, accelerometer, gyro sensor, depth sensor, pressure sensor, temperature sensor, pH sensor, camera, optical sensor, light the like, or any combination thereof configured to be submersible within the monitored body of water.

Processing center 104 is a processing and communication device that provides for undertaking the communication and signal processing required to identify an acoustic drowning signature signal obtained with hydrophone array 102. Processing center 104 implements a processor mediated method (FIG. 2) for identifying the acoustic drowning signature signal.

In embodiments processing center 104 may disposed within the body of water and/or external to the body of water being monitored. In some embodiments processing center may be formed from a plurality of sub-modules wherein a some sub-modules are within the body of water and some sub-modules are external to the body of water.

In embodiments processing center 104 may be functionally associated with the hydrophone array in a wired or wireless manner. Accordingly the hydrophone array 102 may be wireless hydrophones and/or wired hydrophones that are functionally coupled and operational with the processing center and/or device 104.

Processing center 104 comprises a signal processing module 110 and an electronics/circuitry module 130 that provide for identifying an acoustic drowning signature signal within the body of water and implementing an alarm procedure and/or state once the drowning incident is identified and including generating and communicating an alarm signal 105.

Figure 4:
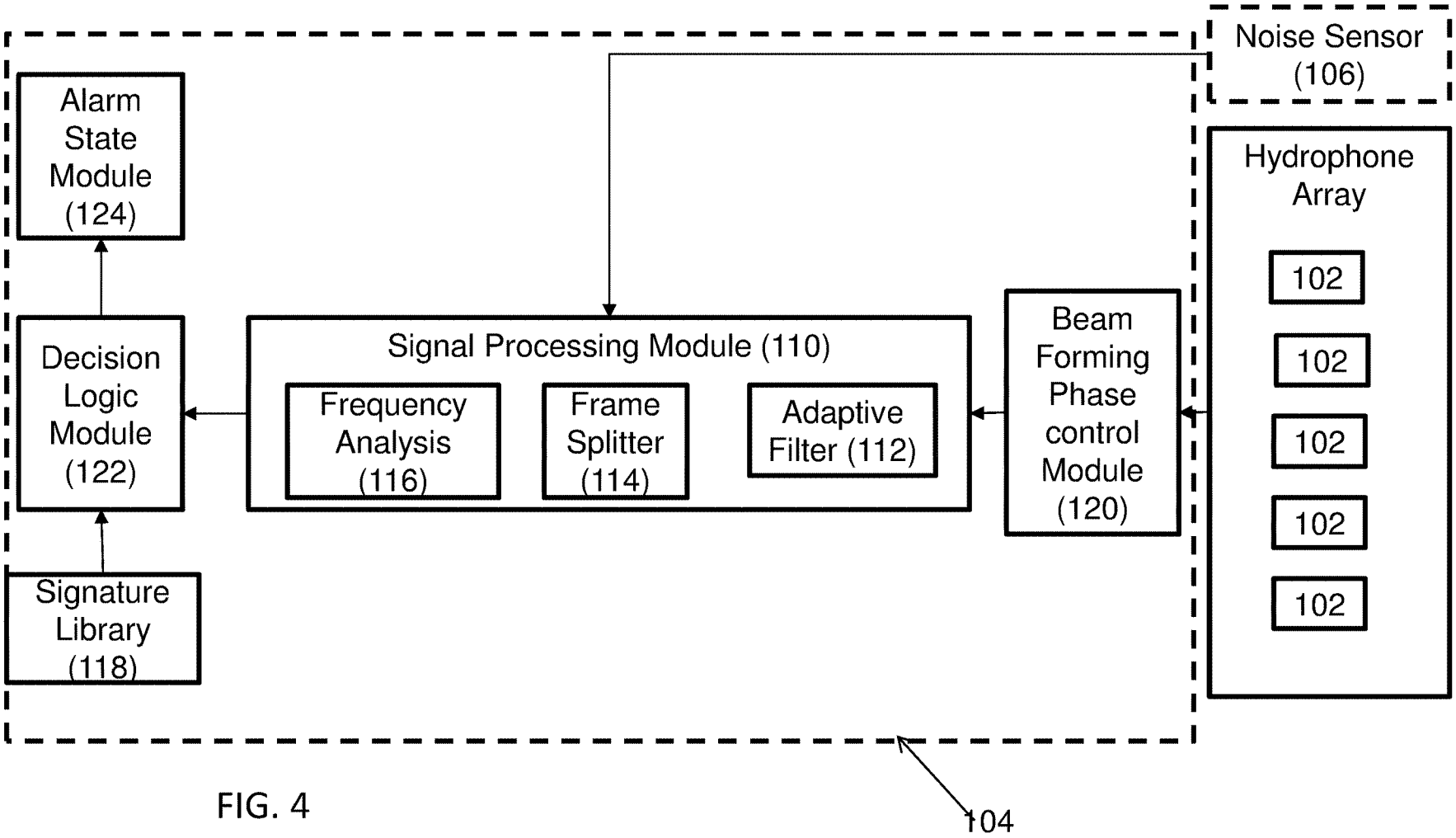
FIG. 4 is a schematic block diagram of a system and method implementation for drowning detections according to an embodiment of the present invention.

Signal processing module 110 preferably provides for implementing the processor mediated method for identifying the acoustic drowning signature signal form the acoustic signals provided by hydrophone array 102, greater detail provided in FIG. 4.

Electronics/circuitry module 130 preferably provides the hardware and/or software necessary to implement the processing and communication necessary to monitor the body of water to identify a drowning acoustic signature.

Electronics/circuitry module 130 comprises a microprocessor sub-module 132, a power sub-module 134, a communication sub-module 136, a memory sub-module 138, the like or any combination thereof.

In embodiments processor sub-module 132 provides the necessary processing hardware and/or software necessary to render processing center 104 functional and/or to render system 100 functional.

In embodiments power sub-module 134 provides the necessary hardware and/or software to power processing center 104 and/or system 100.

In embodiments communication sub-module 136 provides the necessary hardware and/or software to facilitate communication for system 100 with auxiliary devices 20 and/or the hydrophone array 102.

In embodiments memory sub-module 138 provides the necessary hardware and/or software to facilitate operations of system 100 and/or processing center 104.

In embodiments system 100 is preferably in communication with or functionally associated with at least one or more auxiliary devices 20 for communicating an alarm signal 105 indicative of an alarm state and/or sounding an alarm state.

An auxiliary device 20 may for example include but is not limited to a horn, an alarm, a communication device, a mobile communication device, a server, a first respondent call center, emergency services call center, the like or any combination thereof. Optionally, an auxiliary device 20, for example a mobile communication device such as a smartphone, may be fit with necessary software and/or dedicated application (app) to receive an alarm state signal 105.

In some embodiments system, the hydrophone array 102 may be formed from a plurality of sub-arrays that are associated with processing center 104. For example to cover a large body of water a plurality of sub-arrays may be utilized with a single processing center 104.

In embodiments a hydrophone array and/or sub-array may be embedded in a flexible platform and/or housing that maintains the arrangement of the individual hydrophone forming the array and/or sub-array. For example, such a housing and/or flexible platform may be a vinyl surface that is embedded with individual hydrophones and submerged within the body of water being monitored.

In embodiments, the flexible platform and/or housing may be functionally coupled with processing center 104 by wiring or wireless communication.

In embodiments, the housing and/or platform of the hydrophone array 102 and/or sub-array may further comprise a local electronics and circuitry module comprising a power source sub-module, processor sub-module, memory sub-module, and communication sub-module, and wherein the local electronics and circuitry module is functionally coupled with the processing center 104 by way of a wireless communication protocol and/or hard wiring.

In embodiments the platform and/or housing may be a flexible water impermeable material, for example including but not limited to vinyl.

In embodiments, individual hydrophones (102*n*) forming the hydrophone array 102 may be further associated with a local sensor and/or transducer, for example including but not limited to a light source, a pH sensor, a temperature sensor, and/or an accelerometer, the like or any combination thereof.

In embodiments individual hydrophones (102*n*) may be fit with a temperature sensor to determine the temperature in and around the individual hydrophone (102*n*) and the hydrophone array (102). In particular, such a temperature sensor could facilitate signal processing of the sound recorded with the hydrophones.

In embodiments individual hydrophones (102*n*) may be fit with an accelerometer to aid in signal processing, and in particular to improve on signal to noise ratio of the acoustic signal provided by array 102 and/or individual hydrophones 102*n*.

In embodiments individual hydrophones 102*n* may be fit with and or disposed adjacent to a light source, for example a Light Emitting Diode (LED). In embodiments, the LED adjacent to a hydrophone 102*n* may be a multi-color (RGB) LED. In embodiments system 100 may be configured to activate the light source selectively only if a drowning incident is sensed. In embodiments, only the lights adjacent to the location of the drowning event are activated so as to readily identify the location of the drowning incident.

In embodiments, the wavelength of the light source may be selected and/or lit according to its proximity to the drowning event, therein acting to facilitate as a locating and/or honing signal to identify the location of the drowning event, in particular such is advantageous at night or dark environment. For example, light closest to the drowning event/location may be selectively lit as Red while those light that are further away from the drowning event/location may be lit as Blue.

Figure 2:
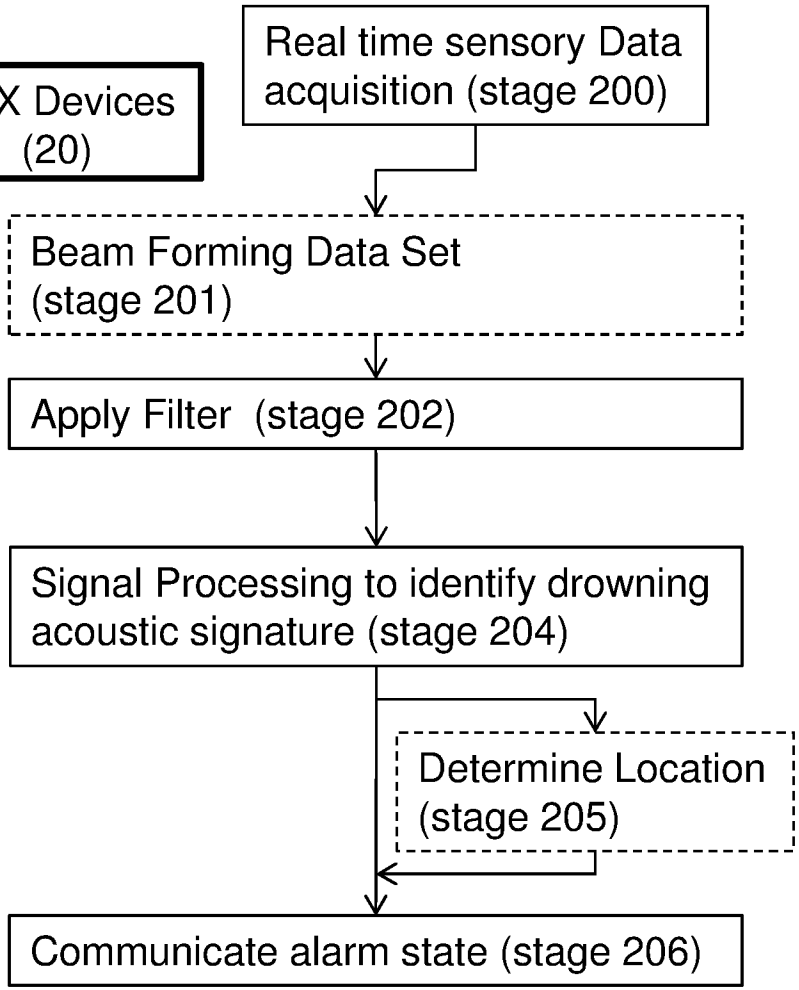
FIG. 2 is a schematic flow chart showing a method for identifying a drowning incident with the system according to the present invention.

FIG. 2 shows a flow chart of a method for identifying a drowning event by way of identifying an drowning acoustic signature within a body of water, for example a swimming pool, that is fit with and monitored with system 100.

First in stage 200, real time acoustic signals are received from the hydrophone array 102 disposed within the body of water being monitored. The acoustic data is communicated to and delivered to processing center 104 for processing substantially in real time.

Next in an optional stage 201, the raw data obtained undergoes beam forming via a phase control module 120 where each hydrophone 102*n* comprising the hydrophone array 102 is utilized to form a plurality of directional acoustic beams in a manner that will cover the area defined by the hydrophone array 102 and the volume of the body of water being monitored. Preferably beam forming facilitates locating the drowning event as will be described below in optional stage 205. In embodiments the phase control module 120 will apply variable phase control shifts to individual hydrophones (102*n*) of the hydrophone array 102 so as to cover the entire monitored body of water.

Next in stage 202, processing center 104 and more preferably signal processing module 110 applies noise reduction filtering so as to clean the hydrophone acoustic signal allowing further processing of the signal. Preferably the filter applied may be applied directly to the data provided by array 102 as well as additional environmental data provided from external sensor module 106. Filtering may for example include adaptive filtering or the like filtering as is known in the art.

Next in stage 204, further signal processing techniques are implemented on the clean signal to identify the drowning acoustic signal within the body of water and an alarm signal 105 is generated. Preferably such signal processing techniques comprise filtering, frame splitting, frequency domain analysis, artificial intelligence decision support analysis, signal decimation, down sampling, up sampling, interpolation, determination of minimum and/or maximums, identifying harmonics, wavelet analysis, power analysis, signal differentiation, signal compression, signal decompression, transformations, regression analysis, or the like as is known in the art.

Next in optional stage 205, if a drowning acoustic signature signal is identified, the processing module further identifies the location of the individual hydrophones (102*n*) that generated and/or picked up and/or are involved in the identification of the drowning signature signal, so as to identify the location of the suspect drowning event. Optionally and preferably during an alarm state preferably the drowning incident location is identified and communicated.

In embodiments, determining the location of the suspect drowning event may comprise: providing individual hydrophones (102*n*) with an address in the form of a geographical coordinates (GPS coordinates), preferably an address is provided during installation of system 100; next determine from the acoustic data which of the hydrophones are involved in generating the acoustic drowning signature signal; finally, cross reference the hydrophones involved in generating the signature signal with the hydrophone's geographical coordinate address to define area of drowning event.

Next in stage 206, alarm state signal 105 is communicated to at least one or more auxiliary device 20 associated with system 100, to undertake an alarm state protocol. Optionally and preferably an alarm state signal 105 may further comprise the location of the drowning event based on location identified in optional stage 205. Preferably the location is provided in the form of geographical coordinates.

Figure 3:
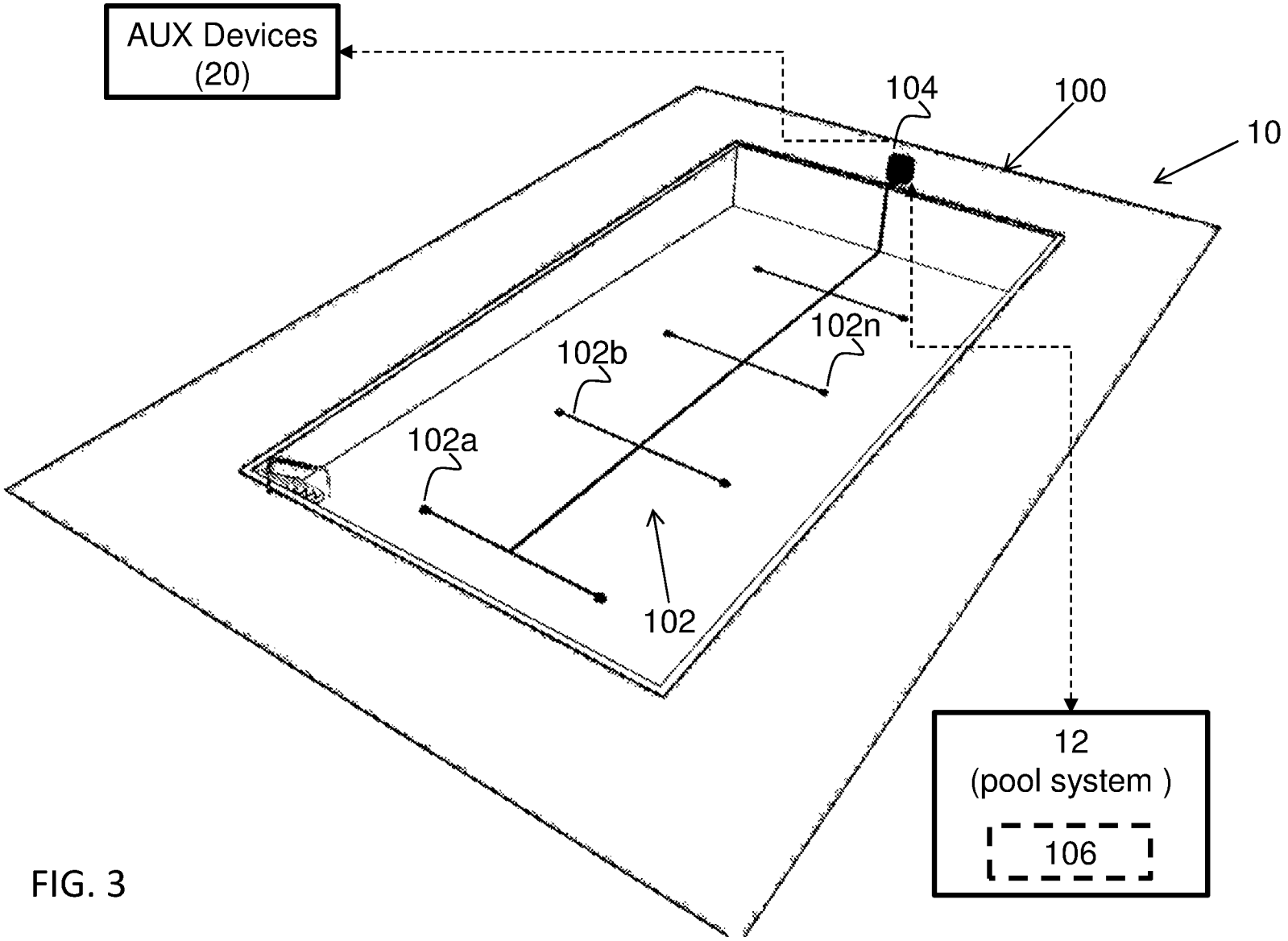
FIG. 3 is a schematic illustration of a swimming pool fit with the system for drowning detection according to an embodiment of the present invention.

FIG. 3 shows a schematic illustration of system 100 as implemented in an in-ground swimming pool 10 setting. As seen hydrophone array 102 comprises a plurality of individually hydrophones 102*a*, 102*b*, 102*n* is disposed along a lower surface of the pool, forming a grid-like coverage of the pool floor. Array 102 is functionally linked and/or associated with processing center 104 shown as being above ground.

System 100, shows pool systems and/or machine rooms 12, comprising filter and pumps, that are fit with an optional sensor 106 that is functionally coupled with processing center 104. Preferably processing center 104 can apply adaptive filters to data received from sensor 106 so as to improve the signal to noise ratio received form array 102.

As shown, system 100 and in particular processing center 104 is further functionally associated with an auxiliary device 20 for receiving an alarm state signal 105 that may be communicated from processing center 104.

While FIG. 3 depicts implementation of system 100 with a built-in swimming pool 10, system 100 is not limited to such implementation and may be utilized in any body of water having a defined and/or definable monitoring area. Such a body of water may for example include but is not limited to at least one or more of an above ground swimming pool, a defined area within a lake, a defined area within a body of water, a defined area within an ocean, a defined area within a sea, a water reservoir, a water tank, an artificial lake, a canal, a bathtub, a Jacuzzi or the like.

FIG. 4 show a further depiction of system 100 showing processing module 110 in greater detail. As shown, acoustic signals from at least one of array 102 and/or sensor 106 are provided to and/or communicated to processing center 104.

In embodiments, the raw acoustic signals from array 102 are communicated to a beam forming phase control module 120 generating directional data set from the hydrophone data provided by array 102.

In embodiments module 120 is utilized to form a plurality of directional acoustic beams in a manner that will cover the area defined by the hydrophone array 102 and the volume of the body of water being monitored. Preferably such beam forming facilitates locating the drowning event relative to the location of the hydrophones.

In embodiments the phase control module 120 will apply variable phase control shifts to individual hydrophones (102*n*) of the hydrophone array 102 so as to form beams that will cover the entire monitored body of water.

Preferably the acoustic directional data set and the external sensor data 106 is communicated to signal processing module 110 to undertake and perform data filtering with an adaptive filter module 112, frame splitting with frame splitting module 114, and to perform frequency analysis with frequency analysis module 116. All provided to identify an acoustic signature signal that is associated with a drowning event. More preferably the acoustic signature has an identifiable frequency band from about 200 Hz and up to about 1200 Hz and optionally up to about 1500 Hz.

The processed data is then provided to decision logic module 122 and/or automated classifier provided that facilitate identifying and/or classifying the signal into a drowning signal or not. Preferably the decision module 122 is rendered with reference to a bank and/or library and/or database 118 comprising a plurality of pre-classified drowning signatures and/or drowning signal criteria. In some embodiments, module 122 may further be provided with artificial intelligence and learning capabilities and able to identify and learn drowning incident over time.

If module 122 positively identifies a drowning incident an alarm state protocol module 124 is implemented. Preferably module 124 generates alarm signal 105 and communicates it to the appropriate auxiliary devices 20, as previously described. More preferably module 124 further communicates the location of the drowning event relative to the location of the hydrophone nearest the drowning incident.

Figure 5A:
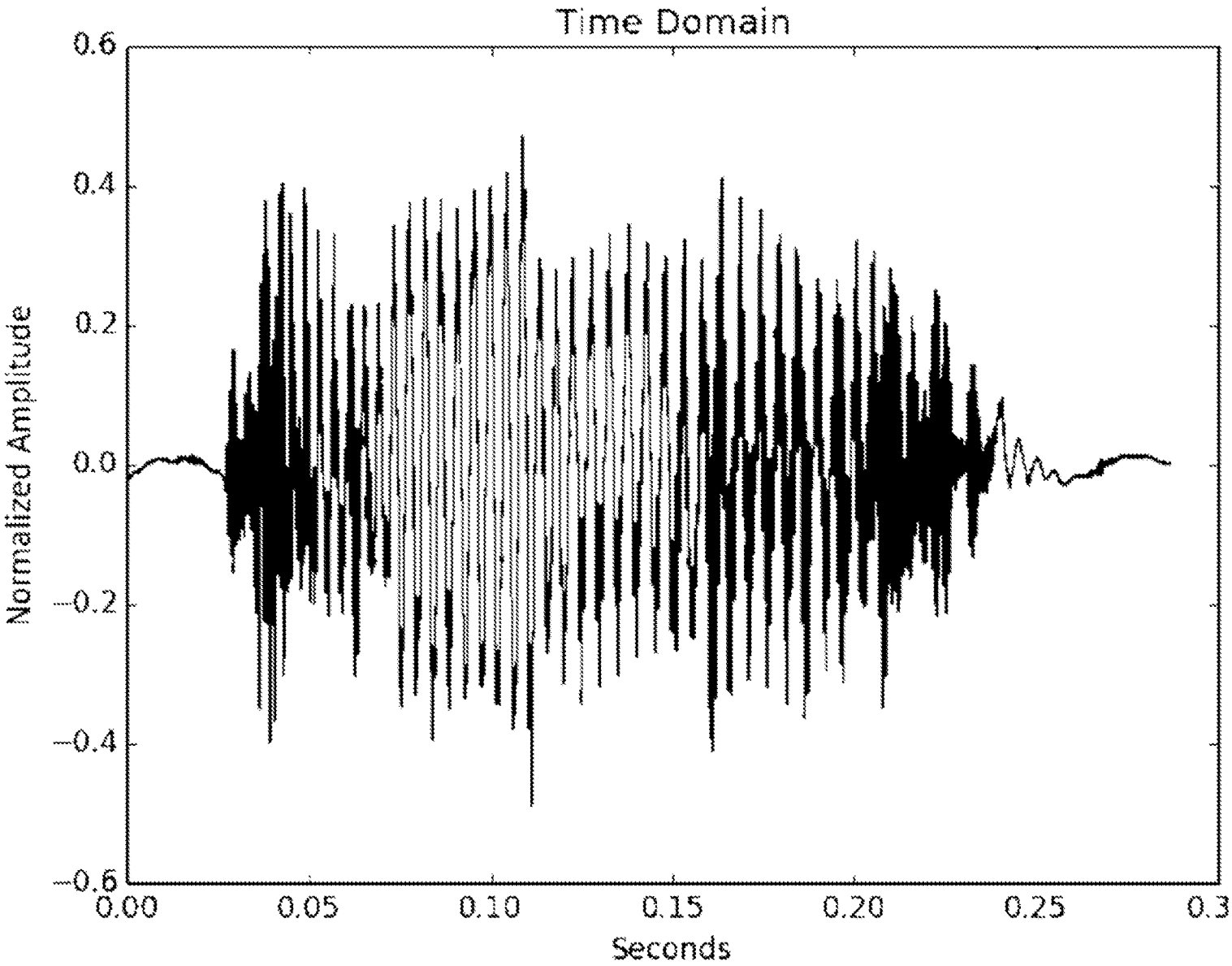
FIG. 5A-B are schematic graphical illustrations of and acoustic signal obtained with the system according to an embodiment of the present invention.

FIG. 5A shows an example of a time domain acoustic signal of a drowning incident as provided by a hydrophone array 102 prior to classification however following adaptive filtering. The signal shown in FIG. 5A does not implicitly show specific signals that are identifiable with a drowning incident, therefore a signature is not readily identifiable from the time domain signal.

Figure 5B:
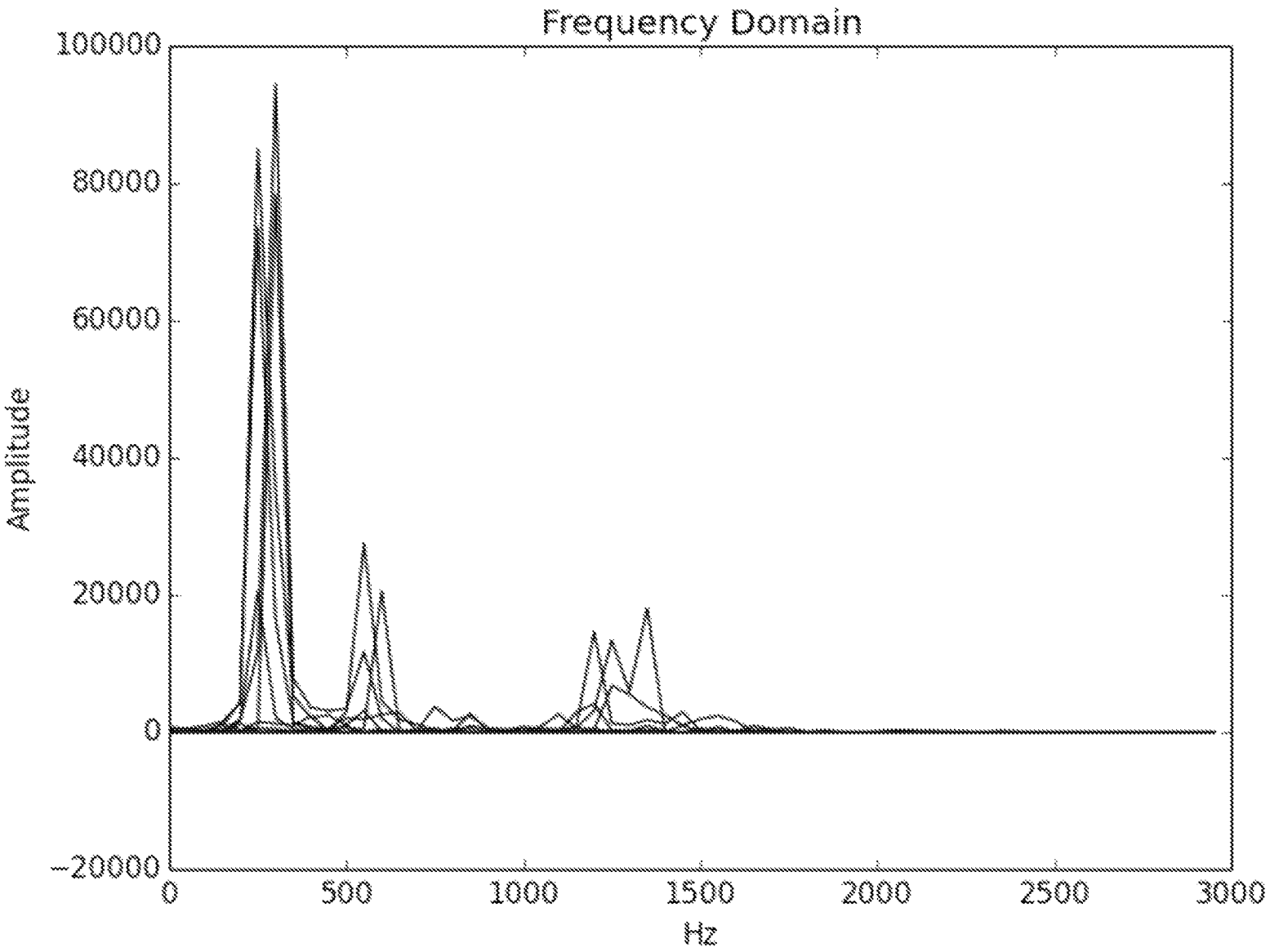

FIG. 5B shows the signal depicted in FIG. 5A, following frequency domain processing where an acoustic signature associated with drowning is visible with frequency bands that are identifiable in the 200 Hz to 1500 Hz.

This acoustic signature is believed to be associated with acoustic waves generated by the body during a drowning event. The drowning sound may be explained on the basis of known anatomical defense reflexes that together are implemented to try to prevent entry of water or unwanted substance into the upper and lower respiratory system. These reflexes include a laryngospasm and a cough reflex that are known to be activated by irritant receptors that are located mainly on the wall of the trachea, pharynx, and carina, or by stimulation of the auricular branch (Arnold's reflex via internal laryngeal nerve). When both reflexes are triggered, axonal impulses of the vagus nerve begin a chain reaction that reaches the medulla, with efferent back in to respiratory system (glottis, vocal cords, diaphragm, intercostal muscles) is observed. A combination of these reflexes activates a blocking and/or repelling defensive actions to prevent water, or the like foreign object, from entering the respiratory system, and in turn gives rise to the unique drowning acoustic signature, monitored by embodiments of the present invention.

While the invention has been described with respect to a limited number of embodiment, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not described to limit the invention to the exact construction and operation shown and described and accordingly, all suitable modifications and equivalents may be resorted to, falling within the scope of the invention.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

Further modifications of the invention will also occur to persons skilled in the art and all such are deemed to fall within the spirit and scope of the invention as defined by the appended claims.

While the invention has been described with respect to a limited number of embodiments, it will be appreciated that many variations, modifications and other applications of the invention may be made.

What is claimed is:

1. A system for monitoring a body of water for a drowning event, the system comprising:

a) a hydrophone array module having a plurality of hydrophones submerged in the body of water;

b) a processing center functionally associated with the hydrophone array module, the processing center having a signal processing module configured for analyzing signals obtained with the hydrophone array module to identify an acoustic signature indicative of a drowning event, the acoustic signature having at least one frequency band peak of up to 1500 Hz characterized in that the acoustic signature is correlated to acoustic waves generated by a drowning individual during the drowning event.

2. The system of claim 1 wherein said acoustic signature is a frequency band having peaks between 200 Hz and 1200 Hz.

3. The system of claim 1 wherein said processing center is further configured to identify a location of the drowning event within the body of water relative to the hydrophone array, the location identified by utilizing a phase control module provided with said processing center.

4. The system of claim 3 wherein said phase control module generates an acoustic beam data set from data provided with said hydrophone array.

5. The system of claim 1 further comprising a non-aqueous sensor module comprising at least one or more sensors placed external to the monitored body of water.

6. The system of claim 5 wherein said body of water is a swimming pool and wherein said sensor module comprises at least one microphone disposed in the swimming pool's machine room; and wherein data from said microphone is communicated to said processing center for adaptive filtering so as to reduce noise from data obtained from the hydrophone array.

7. The system of claim 1 further comprising an aqueous sensor module comprising at least one sensor selected from: movement sensor, accelerometer, gyro sensor, depth sensor, pressure sensor, temperature sensor, pH sensor, camera, optical sensor, light sensor, or any combination thereof.

8. The system of claim 1 wherein said hydrophone array is arranged along at least one of a lower surface or a side surface defining the body of water.

9. The system of claim 1 wherein said hydrophone array comprises a first hydrophone array arrangement disposed along a lower surface of the body of water and a second hydrophone array arrangement disposed along the height of the body of water along at least one or more side wall surface.

10. The system of claim 1 wherein said body of water is selected from a swimming pool, an above ground swimming pool, a built in swimming pool.

11. The system of claim 10 wherein said above ground swimming pool and wherein said hydrophone array is embedded and/or incorporated within the material forming said above ground swimming pool.

12. The system of claim 11 wherein said material is vinyl.

13. The system of claim 11 wherein said hydrophone array is embedded along a surface selected from: along a lower surface of said above ground swimming pool, along a side surface or side wall of said above ground swimming pool, along both a lower surface and a side surface of said above ground swimming pool.

14. The system of claim 10 wherein said hydrophone array is embedded or integrated with at least one of a swimming pool floor or a side wall.

15. The system of claim 1 further comprising a light source disposed adjacent to individual hydrophones forming the hydrophone array.

16. The system of claim 15 wherein the light source is an LED, a submersible LED, or a multi-color LED.

17. The system of claim 15 wherein said light source is configured to be activated once a drowning event is sensed.

18. The system of claim 17 wherein said light source is lit with a wavelength selected according to said light source's proximity to the drowning event.

19. The system of claim 1 wherein individual hydrophones are provided with a unique address indicative of the hydrophone geographic location and location relative to one another.

20. The system of claim 19 wherein said address is provided in the form of a GPS address or GPS coordinates.

21. The system of claim 1 wherein the hydrophone array is arranged adjacent to at least one of a lower surface or a side surface defining the body of water, wherein at least one hydrophone of said hydrophone array is disposed at a distance (d) from the lower surface or side surfaces and wherein distance (d) is in the order of a few centimeters or up to 15 centimeters.

22. A system for acoustic monitoring of a body of water, the system comprising:

a) a flexible platform embedded with a hydrophone array module having a plurality of hydrophones arranged about said platform, the platform configured to be disposed internal to said body of water; and b) a processing center functionally associated with said flexible platform, the processing center having a signal processing module configured for analyzing signals obtained with the hydrophone array module to identify an acoustic signature having a frequency band between 200 Hz and 1200 Hz that is indicative of a drowning event.

23. The system of claim 22 wherein said flexible platform is functionally coupled with said processing center with at least one selected from: by wiring, by way of wireless communication.

24. The system of claim 22 wherein said platform further comprises an electronics and circuitry module, said module comprising a power source sub-module, processor sub-module, memory sub-module, and communication sub-module, and wherein said electronics and circuitry module is functionally coupled with said processing center by way of a wireless communication protocol or hard wiring.

25. The system of claim 22 wherein said platform is a flexible water impermeable material.

26. A processor implemented method for monitoring a body of water for a drowning event with an array of a plurality of hydrophones submerged within the monitored body of water, the method including:

a) obtaining a real-time acoustic signal data set from the hydrophone array;

b) implementing beam forming protocol by applying a phase control to said real-time acoustic signal data set such that each of the hydrophones generate a directional beam and said data set is transformed to form a transformed data set;

c) applying an adaptive filter to reduce noise from the transformed data set generating a filtered data set;

d) rendering a frame splitting protocol to the filtered data set to generate a frame split data set;

e) performing a frequency analysis on the frame split data set to identify a drowning signature frequency band indicative of a drowning event having a frequency between 200 Hz and 1200 Hz;

f) comparing the filtered data set to an acoustic signature library and rendering a decision if a drowning event is occurring;

g) apply an alarm protocol if a drowning event is sensed.

27. The method of claim 26 further comprising performing a locating sequence to identify the origin of drowning signal for identifying a location of the drowning event by identifying the individual hydrophones from within said hydrophone array that are that correspond to the detected signature frequency band.

* * * * *